US006880304B1

(12) United States Patent
Budge

(10) Patent No.: US 6,880,304 B1
(45) Date of Patent: Apr. 19, 2005

(54) STRUCTURAL THERMAL FRAMING AND PANEL SYSTEM FOR ASSEMBLING FINISHED OR UNFINISHED WALLS WITH MULTIPLE PANEL COMBINATIONS FOR POURED AND NONPOURED WALLS

(75) Inventor: Paul W. Budge, St. George, UT (US)

(73) Assignee: JenTec Industries, Inc., St. George, UT (US)

( * ) Notice: Subject to any disclaimer, the term of this patent is extended or adjusted under 35 U.S.C. 154(b) by 0 days.

(21) Appl. No.: 10/658,649

(22) Filed: Sep. 9, 2003

Related U.S. Application Data

(63) Continuation of application No. 09/938,713, filed on Aug. 23, 2001, now abandoned.
(60) Provisional application No. 60/197,039, filed on Aug. 23, 2000.

(51) Int. Cl.[7] ..... E04B 2/00
(52) U.S. Cl. ..... 52/426; 52/277; 52/294; 52/424; 52/562; 52/275; 52/276; 52/568; 52/745.09; 52/481.1; 249/216; 249/218; 249/193
(58) Field of Search ..... 52/276, 277, 426, 52/278, 279, 294, 424, 562, 568, 745.09, 481.1, 275; 249/216, 218, 193

(56) References Cited

U.S. PATENT DOCUMENTS

| | | | | |
|---|---|---|---|---|
| 4,114,333 A | | 9/1978 | Jones et al. | 52/265 |
| 4,161,087 A | | 7/1979 | Levesque | 52/62 |
| 4,163,349 A | | 8/1979 | Smith | 52/241 |
| 4,720,948 A | | 1/1988 | Henley et al. | 52/90 |
| 4,888,931 A | | 12/1989 | Meilleur | 52/426 |
| 4,967,528 A | | 11/1990 | Doran | 52/309.12 |
| 5,099,628 A | | 3/1992 | Noland et al. | 52/426 |
| 5,279,089 A | | 1/1994 | Gulur | 52/309.11 |
| 5,311,718 A | | 5/1994 | Trousilek | 52/425 |
| 5,390,459 A | | 2/1995 | Mensen | 52/426 |
| 5,456,444 A | | 10/1995 | Wegman | 249/40 |
| 5,459,970 A | | 10/1995 | Kim | 52/424 |
| 5,570,552 A | | 11/1996 | Nehring | 52/426 |
| 5,649,401 A | | 7/1997 | Harrington | 52/426 |
| 5,704,180 A | | 1/1998 | Boeck | 52/426 |
| 5,809,726 A | | 9/1998 | Spude | 52/426 |
| 5,882,540 A | | 3/1999 | Farrington | 249/34 |
| 5,992,114 A | | 11/1999 | Zelinsky et al. | 52/426 |
| 6,026,620 A | * | 2/2000 | Spude | 52/275 |
| 6,622,452 B1 | * | 9/2003 | Alvaro | 52/742.14 |
| 6,698,710 B1 | * | 3/2004 | VanderWerf | 249/216 |

* cited by examiner

*Primary Examiner*—Carl D. Friedman
*Assistant Examiner*—Christy Green
(74) *Attorney, Agent, or Firm*—Holme Roberts & Owen LLP

(57) ABSTRACT

A novel structural thermal framing and panel system for assembling finished or unfinished walls with multiple combinations for poured and nonpoured walls comprising of a permanent structural framing stud which can be adjusted to different wall thickness, a plurality of permanent forms, wherein the pluralities of permanent forms are interchangeable with various other permanent panel forms with or without defined spaces for receiving filler, and wherein the framing stud substantially conforms to a portion of the pluralities of panel forms and resists bending in the panel forms. The framing stud is the main structural element in the wall. A structural framing system in combination with insulated panel forms with various defined spaces for receiving filler, and wherein panels may not be prefinished to form a rigid substrate. A method or forming a combination of various poured or nonpoured filler walls to form a structural, solid filled wall, post and beam filled wall, or a solid insulated structurally framed nonfilled wall. A structural framing element with multiple usage for forming walls, a process for forming structural framed walls. A method of forming variable configuration key grooved panel forms to form a variety of different wall thickness and pour configurations to form post and beam, post and beam matrix, solid poured walls, and solid nonpoured walls. An economical multiple use building system with extremely high R values.

8 Claims, 12 Drawing Sheets

STRUCTURAL THERMAL FRAMING AND PANEL SYSTEM FOR ASSEMBLING FINISHED OR UNFINISHED WALLS WITH MULTIPLE PANEL COMBINATIONS FOR POURED AND NONPOURED WALLS

CROSS REFERENCE TO RELATED APPLICATIONS

The application is a continuation of application Ser. No. 09/938,713, filed August 23, 2001, now abandoned, entitled "Structural Thermal Framing and Panel System for Assembling Finished or Unfinished Walls with Multiple Panel Combinations for Poured and Nonpoured Walls," and to Provisional Application Ser. No. 60/197,039, filed Aug. 23, 2000, both of which are incorporated herein in their entirety, and to both of which priority is claimed.

BACKGROUND

1. Field of the Invention

This invention relates in general to a building system for residential and commercial buildings. Specifically, to permanent, thermal panel forms for poured and nonpoured walls in combination with high strength thermally efficient structural framing members or studs.

2. Description of Prior Art

Prior art, traditionally concrete walls are built by erecting wooden or metal forms into which concrete is poured. These forms are structurally rigid and, when properly secured, produce a straight wall. Once the concrete has hardened, the forms are removed and either discarded or moved to the next construction site. Concrete, however, does not provide the most efficient thermal barrier, nor does it provide a suitable surface for attaching interior sheet rock and wall boards or exterior siding and facades. Erection and removal of these large heavy forms is a labor intensive procedure and transportation costs for moving the forms from one construction site to another is expensive. Most prior art building structures use large amounts of concrete and have elaborate engineered steel frames. Whereas, my invention uses minimal amounts of concrete in combination with other building materials and the steel frame having the ability to be adjusted to accommodate different wall widths and is used for the permanent support for the structural thermal framing and panel system.

Another type is an insulated, poured concrete wall having internal and external insulation, drywall or other surface preparation connecting areas which are continuous of and extending the entire or selected lengths of the wall and apparatus for the provision of windows into the wall. This is elaborate and more expensive than my invention. Whereas, my invention has fewer parts to assemble making it more cost effective.

Another type is a method for constructing a wall of a building includes the steps of providing a footing form to outline a horizontal dimension for the wall. Having a wall form ring material between opposing sides of the footing form and allowing the poured wall forming material to set to provide a wall base. Having a first wall and a second wall being opposite to the first wall forming an upright structure forming a wall. This system is more elaborate and more expensive than my invention. This prior art system lacks the ability to adjust to a multi-width whereas, my invention has the ability to adjust making different width walls by adjusting the steel frame.

Another type is a building form system and apparatus including T-shaped and U-shaped lengths of extruded plastic or steel coupled at their sides by rigid links. The links are preferably coupled at ninety degree angles along the lengths of the T-shaped and U-shaped elongated members. This system has more assembled parts than my invention making it more costly and it takes more assembly time.

Another type is a concrete form system having plurality of foam panels which are interlocked transversely, horizontally and vertically by a plurality of connectors. This system is very expensive in comparison to my invention.

Another type is a prefabricated wall forming structure for constructing reinforced concrete wall employs insulating foam plastic panels that are interlocked into two parallel concrete impervious walls by I-beam channels that are spaced apart by tie elements. The tie elements can support horizontal or vertical reinforcing bars and prevent the foam wall from spreading apart under the hydraulic pressure of the poured concrete. This system has more parts to assemble than my invention making more costly assembly and this system lacks the ability to be adjustable. My invention has an adjustable frame giving it the ability to adjust to different widths.

Another type is a modular wall construction system includes a box-like block form of expanded foam plastic material such as polystyrene having opposite, parallel, spaced apart side walls and end walls extending between upper and lower surfaces and defining an internal cavity for receiving concrete slurry. This system takes more concrete to form the internal wall making it more expensive and less versatile than my invention.

Another type is a concrete structure made from precast concrete structures. Having an outer wall and an inner wall forming an inter-region between the walls allowing reinforcing concrete to be added. This is an elaborate system which is more costly than my invention.

Another type is a wall form assembly having a pair of form wall assemblies which are kept in preselected spaced parallel relationship by means of cross members fitted within end slots and interlocked by means of pins with elongated braces mounted for movement from a low profile position for transport to a high profile operative position in which the width dimension is transverse to the plane of the form wall for maximum resistance to bowing from the hydrostatic pressure of wet concrete. This is a system for forming a wall than a wall itself. Whereas, my invention is a wall system which becomes the wall itself and has a framing stud which has the ability to adjust for different widths of wall. My invention has very small amounts of concrete needed in combination with different types of building materials.

Another type is a building component comprising first and second high density foam panels each having inner and outer surfaces, top and bottom, and first and second ends, the panels arranged in spaced parallel relationship with their inner surfaces facing each other, and at least two bridging members extending between and through and molded into the panel members, each bridging members comprising a pair of elongated end plates oriented in the top to bottom direction of the panels and abutting against the outer surfaces of the panels, and at least one web member extending between and rigidly connected to the end plates, each web member oriented in the top to bottom direction of the panels and having a height substantially less than the height of the panels. This system requires a large amount of concrete to construct the interior part of wall whereas, my invention takes less concrete in forming the interior part of the wall and my invention has the ability to be adjusted to different widths since the reinforcement frame has an adjustment feature allowing it to be of different widths.

Another type is a multi-component modular system for use in fabricating wall structures of the type which may be fortified with concrete or other similar materials. This system has no adjustable feature for different widths where, my invention does. My invention has a support frame which can be adjusted to different widths, therefore, one framing stud can be adjusted to multi-width wall thickness, thereby, having a multi use.

Another type is a masonry structure reinforcing and confinement apparatus is disclosed for enhancing the structural integrity under stress of masonry structures formed of a plurality of stacked masonry units. This system is for a masonry system only. My invention is for a wall forming system, therefore, my invention is not a masonry system.

Another type is a construction block to be used with other similar blocks in order to construct panels of a building which is formed of a pair of substantially planar panels located in juxtaposition and spaced apart forming a space between the panel. This system is a block system whereas, my invention is a panel system.

Another type is an insulating form work for casting a concrete wall, the form work having a pair of side walls, each of which is made up of a plurality of coplanar edge-abutting modular panels made of insulating foam material. Each panel has upper and lower edges with coplanar slits provided there along, and a pair of vertical end edges respectively provided with a tongue-and-groove to form vertical tongue-and-groove joints with other like adjoining panels. This system has a first group of angle-irons having vertical branches fitting into the upward slits of the panels and horizontal branches pierced with holes extending toward the panel inner face. The panels are also interconnected by a second group of angle-irons having vertical branches fitting into the downward slits of the panels and horizontal branches also pierced with holes extending toward the panel inner face and overlapping the horizontal branches of the angle-irons of the first group. The holes register together and the tie-rods hold the side walls together. The tie-rods have a central portion between the side walls and bent end portions extending through the panels. Elbows between the portions fit into the rabbets. This system does not have the ability to be adjusted to various widths whereas, my invention has this ability making it more versatile, also, less labor intense.

Another type is a modular synthetic plastic concrete form structure for forming a concrete wall or free form or an enclosure having a curved corner. The side panels are positioned in spaced opposed relation. Ties connect the panels in transversely spaced relation and with the panels and the ties being permanently attached with the concrete poured between the panels as a reinforcing and heat insulator. This system has ties that are not able to be adjusted to various widths by using the same framing stud for all different wall thickness, which makes my invention more unique.

Another type is a prefabricated module comprising a three-dimensional armature formed by welded wires and flat elements from light and/or heat-insulating material, retained on either side of the armature to form at least one continuous panel. This system is very complex because of all the welded wires going vertical and horizontal. Because of the complex wire system involved, it's very labor intense making it costly to assemble whereas, my invention is more simplistic making it less labor intense and less costly. Also, my invention, having the adjustable feature that the same framing stud can be used for different width walls, makes my invention novel.

Another type is it has vertical members set in a common base each having spaced pairs of flanges with vertical recess between the flanges of each pair receiving and retaining fastening means by which plasterboard sheets are secured, in spaced relation to the vertical members and defining a molding cavity between metal foil on the facing surfaces of the sheets a core of no-fines concrete being set in said cavity. This system has no adjustable framing studs that can be adjusted to various widths for wall width whereas, my invention has a framing stud that has the ability to be adjusted so the same framing stud can be used for various width walls, which makes my invention unique.

Another type is a wall unit assembly having a steel skeleton frame which cannot be adjusted but is rigid whereas, my invention is adjustable so the same framing stud can be used for various width walls, which makes my invention unique because of the adjustable feature.

OBJECTS AND ADVANTAGES

Accordingly, besides the objects and advantages described above, several objects and advantages of the present invention are:

(a) to provide for an improved thermal-efficient, cost effective permanent wall framing and wall forming system.

(b) to provide for an improved wall forming system which holds the building panels in a desired position so the resultant wall is straight.

(c) to provide a permanent frame stud producing a finished wall which has much greater structural integrity than previous wall forming systems.

(d) to allow pluralities of forms or building panels define a space for receiving filler.

(e) to provide a framing stud that will resist bending in the wall.

(f) to provide a framing stud which is the substantial structural component in a filled or unfilled finished wall.

(g) to provide a permanent framing stud that allows the erection of a solid single panel form for pouring just a concrete header and poured corners, or panels that form a post and beam matrix concrete structure.

(h) to provide a panel with no defined spaces for receiving filler and is solely a steel framed wall.

(i) to provide for a specially designed and engineered framing stud which has a rigid center webbing and rigid outer flanges, this combination forms a structural stud with truss type strength.

(j) to provide when this structural stud is used in combination with concrete the structural properties of the stud is further improved.

(k) to allow the concrete to form around the structural webbing thereby becoming a part of the webbing. This webbing is connected to a rigid inner and outer cord or flange that is offset from the outer edge of the concrete, thus moving the compression and tension zone out from the center axis point.

(l) to allow the structural formed stud in combination with a thin concrete wall to be comparable in overall strength to a much thicker concrete wall.

(m) to provide for better seismic properties for the overall wall.

(n) to allow all panels or panel forms in this system to be prefinished on the exterior facings prior to delivery.

(o) to provide improved shear strength of the panel.

(p) to provide a keyed grooving process that allows the user the ability to easily modify the panel by sliding filler pieces in between two panel forms thereby allowing the panel the ability to form walls in various thickness and the ability to pour filler in defined areas within the panel to form posts and beams or to form openings in the poured wall for windows and doors.

(q) to provide multiple flange receptacle grooving or slots on both ends of the panel allowing for even more pour combinations and the ability to form various thickness of walls with one combination panel.

(r) to provide a framing stud with an adjustable feature allowing the frame support to adjust to various widths thereby one framing stud will fit various walls having different width thickness.

(s) to provide bend out stud brackets that are part of the framing for holding horizontal and/or vertical rebar in a desired configuration, thereby these brackets add structural strength to the webbing of the stud frame.

(t) to provide bend out brackets which are part of the framing stud for fastening to footings or other substrates without the use of "L", "C", or "U" channels.

It is an object of the present invention to provide an improved structural thermal framing panel system for assembling finished or unfinished walls with multiple panel combination for poured and nonpoured walls.

Other objects and features are readily apparent from the following description of certain preferred embodiments thereof taken in conjunction with the accompanying drawings although variations and modifications may be affected without departing from the sphere and the scope of the normal concepts of the disclosed invention. You will find further objects and advantages of the invention from a consideration of the ensuing descriptions and accompanying drawings.

DRAWING FIGURES

DRAWING REFERENCE NUMERALS

Figure 1:
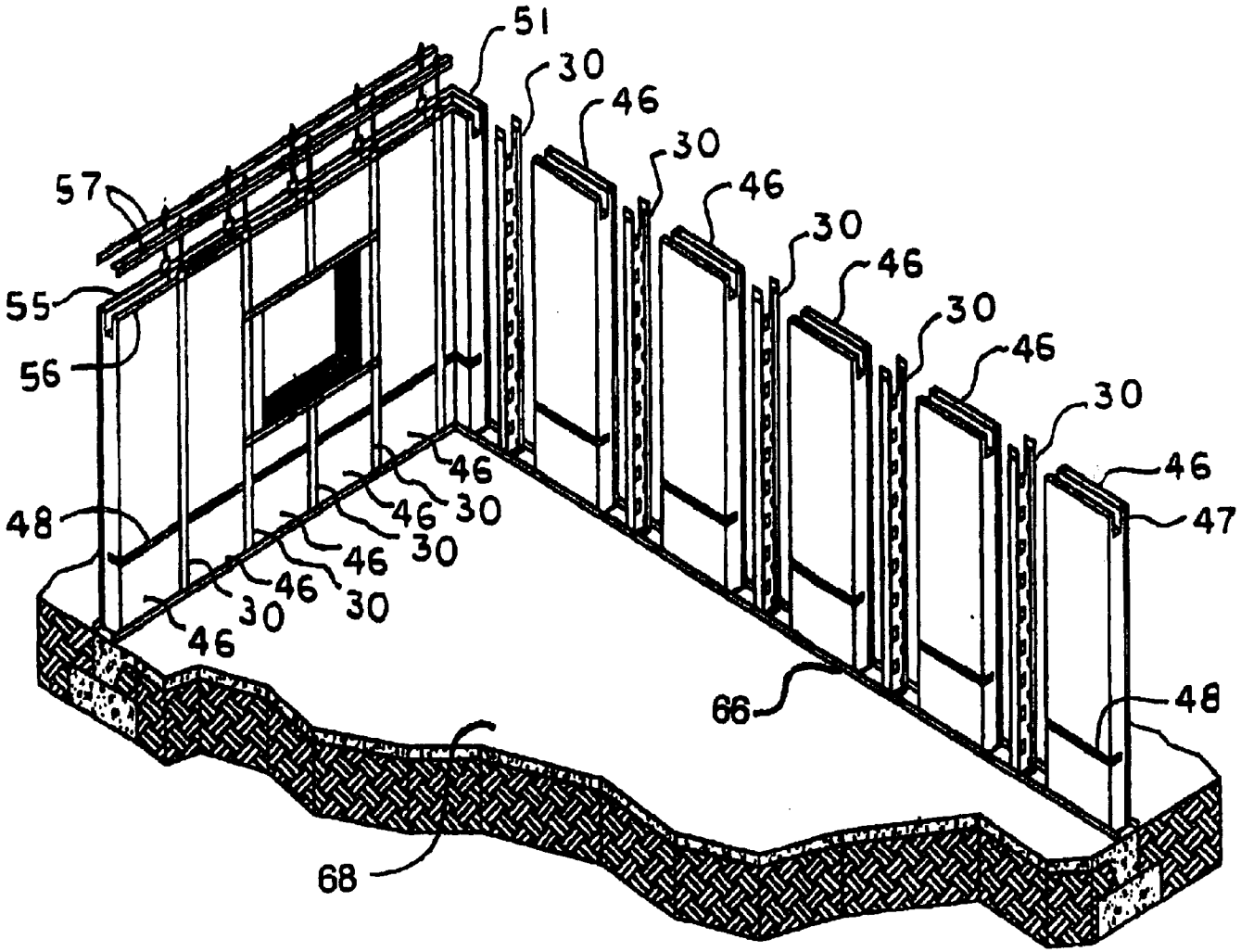
FIG. 1 Shows a perspective break-out view of the thermal steel framing stud and insulated panel assembly.

29 The structural thermal framing and panel system for assembling finished or unfinished walls with multiple combinations for poured and nonpoured walls
30 framing stud assembly
31 first end
32 second end
33 web first end
34 web second end
35 flange first end
36 flange second end
37 slotted interlock receiver hole second end
38 interlock tab first end
39 top tab first end
40 top tab second end
41 bottom tab first end
42 bottom tab second end
43 rebar holder second end
44 electric utility hole first end
45 electric utility hole second end
46 straight insulated panel
47 top groove for header
48 groove for electric utility conduit
49 slot for framing stud flange
50 inset area for framing stud flange
51 outside 90 degree corner insulated panel
52 inside 90 degree corner insulated panel
53 inside 45 degree corner insulated panel
54 outside 45 degree corner insulated panel
55 top ⅂ shaped header
56 top ⅃ shaped header
57 ∟ shaped slotted connector angle
58 slotted receiver hole for top tab
59 straight thin insulated panel
60 45 degree long corner thin insulated panel
61 45 degree short corner thin insulated panel
62 90 degree long corner thin insulated panel
63 90 degree short corner thin insulated panel
64 concrete filler
65 horizontal rebar

DESCRIPTION OF INVENTION

Figure 2:
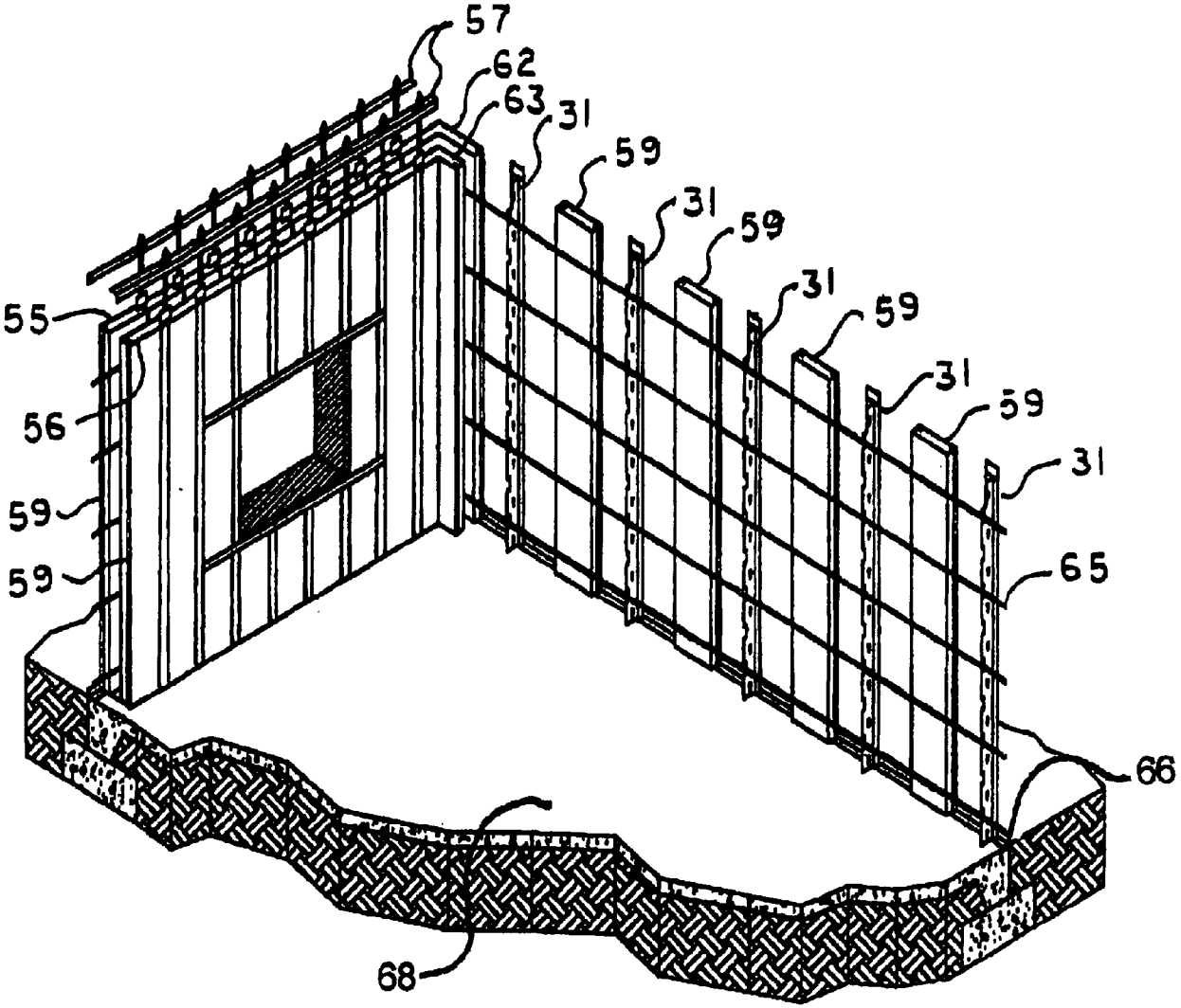
FIG. 2 Shows a perspective break-out view of the steel framing stud and insulated concrete panel assembly.
Figure 4:
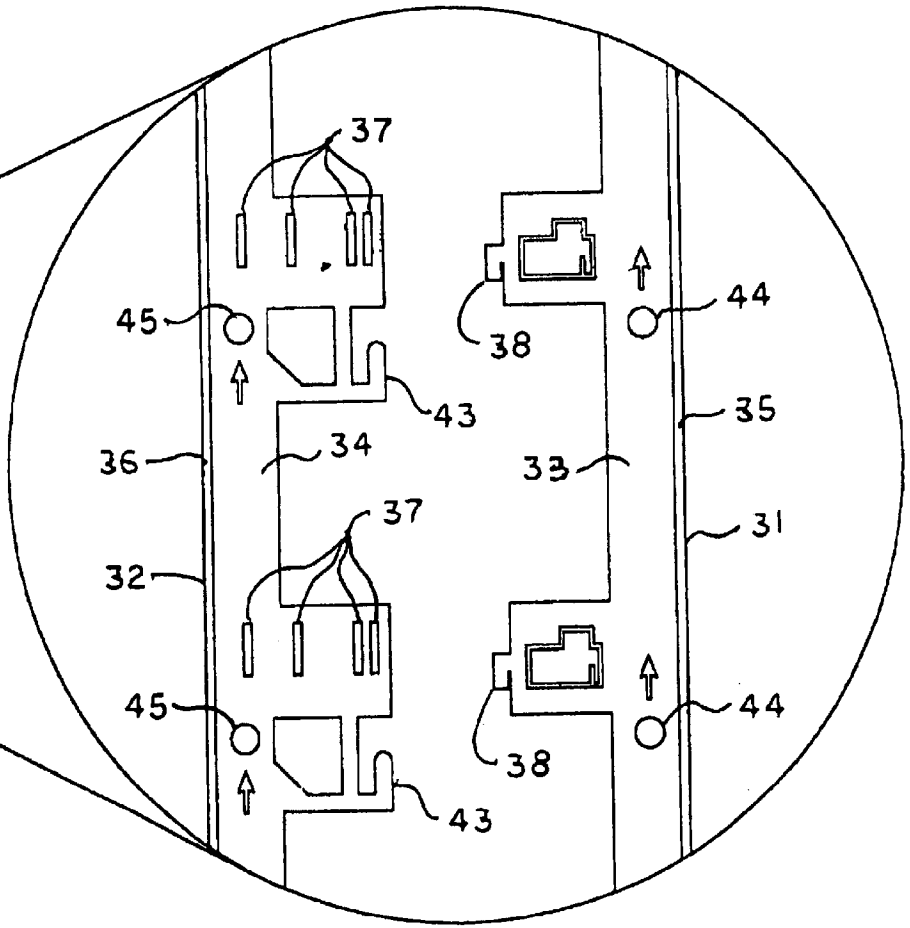
FIG. 4 Shows a blow-up view of the framing stud first and second ends with adjustable means.
Figure 3:
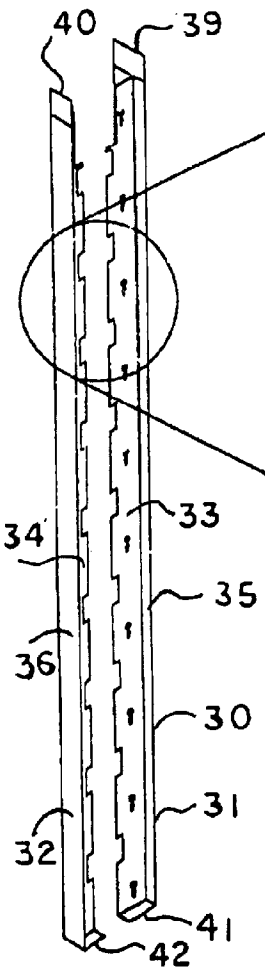
FIG. 3 Shows a perspective view of the framing stud.
Figure 5:
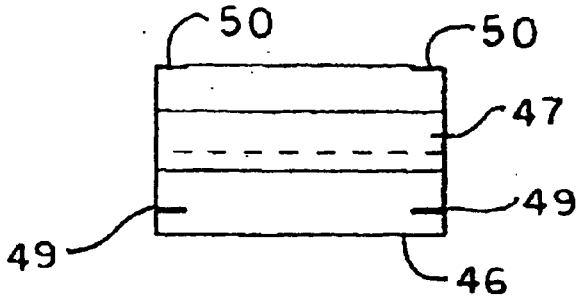
FIG. 5 Shows a top view of a straight insulated panel.
Figure 6:
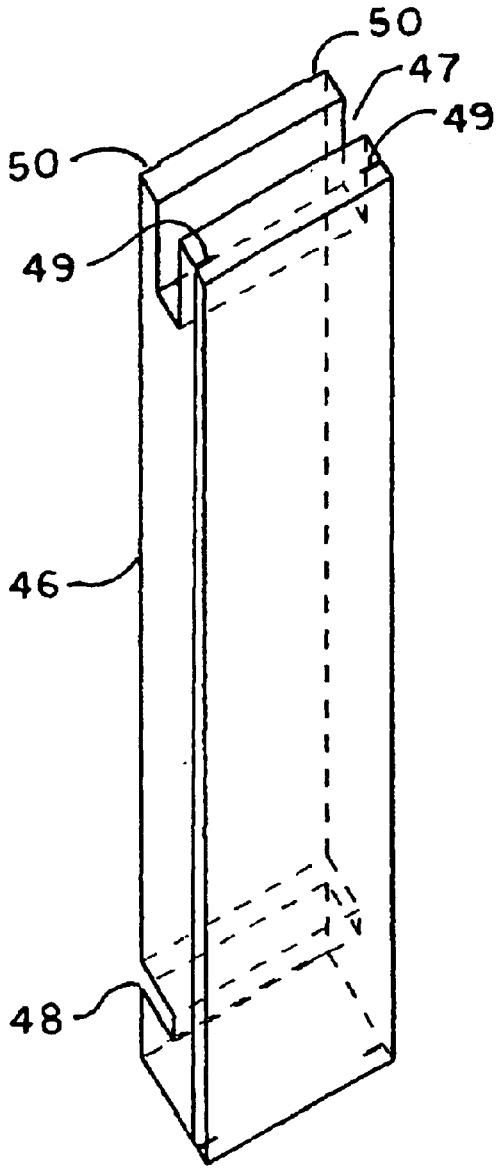
FIG. 6 Shows a perspective view of a straight insulated panel.
Figure 7:
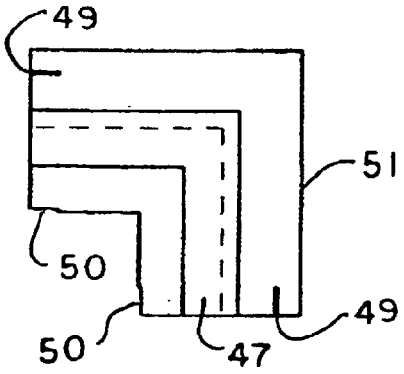
FIG. 7 Shows a top view of an outside 90 degree corner insulated panel.
Figure 9:
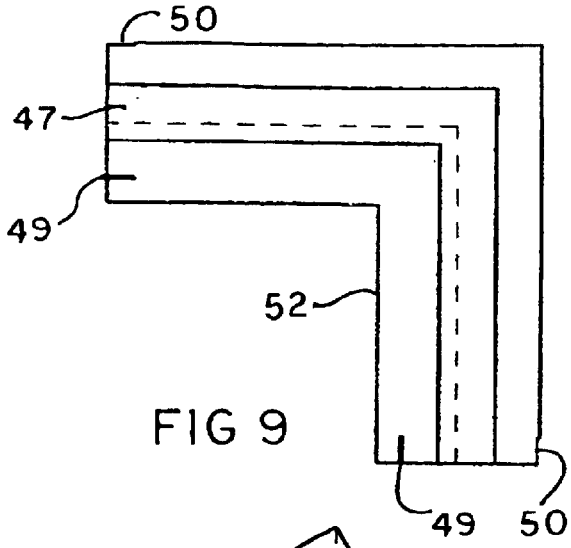
FIG. 9 Shows a top view of an inside 90 degree corner insulated panel.
Figure 8:
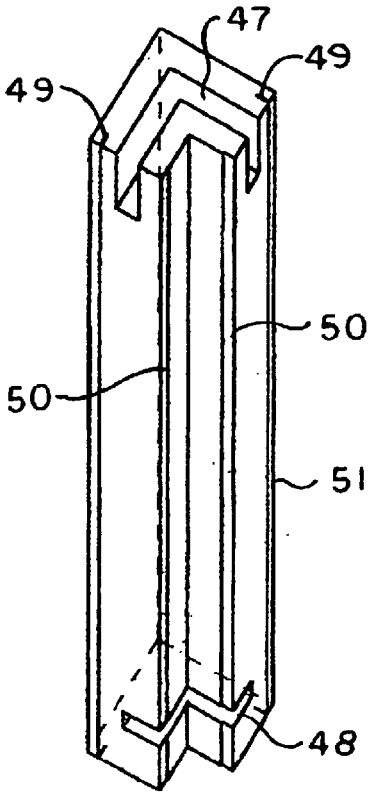
FIG. 8 Shows a perspective view of an outside 90 degree corner insulated panel.
Figure 10:
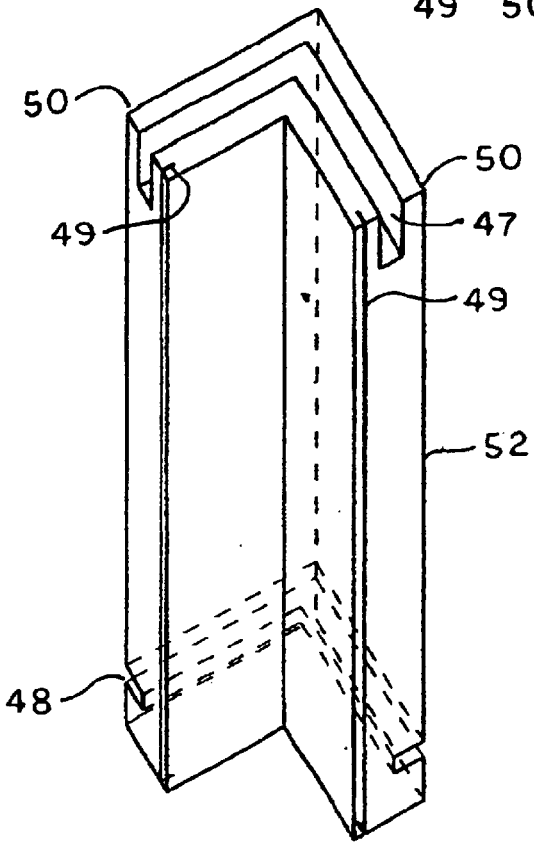
FIG. 10 Shows a perspective view of an inside 90 degree corner insulated panel.
Figure 11:
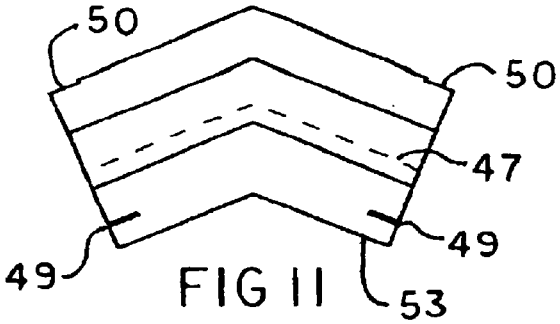
FIG. 11 Shows a top view of an inside 45 degree corner insulated panel.
Figure 13:
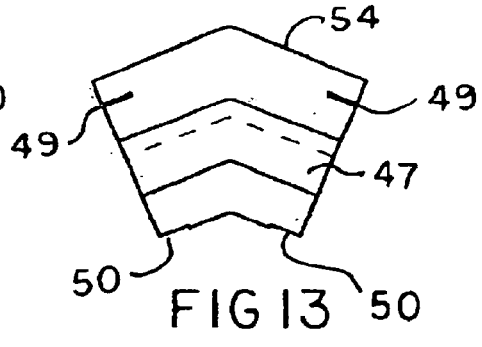
FIG. 13 Shows a top view of an outside 45 degree corner insulated panel.
Figure 12:
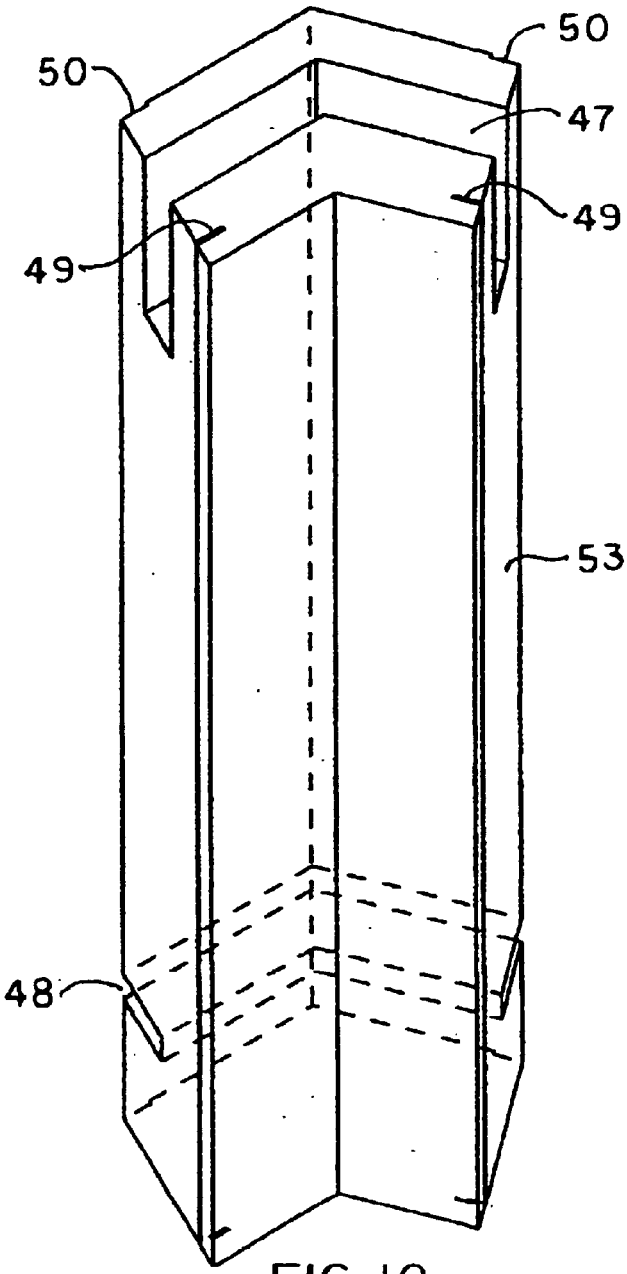
FIG. 12 Shows a perspective view of an inside 45 degree corner insulated panel.
Figure 14:
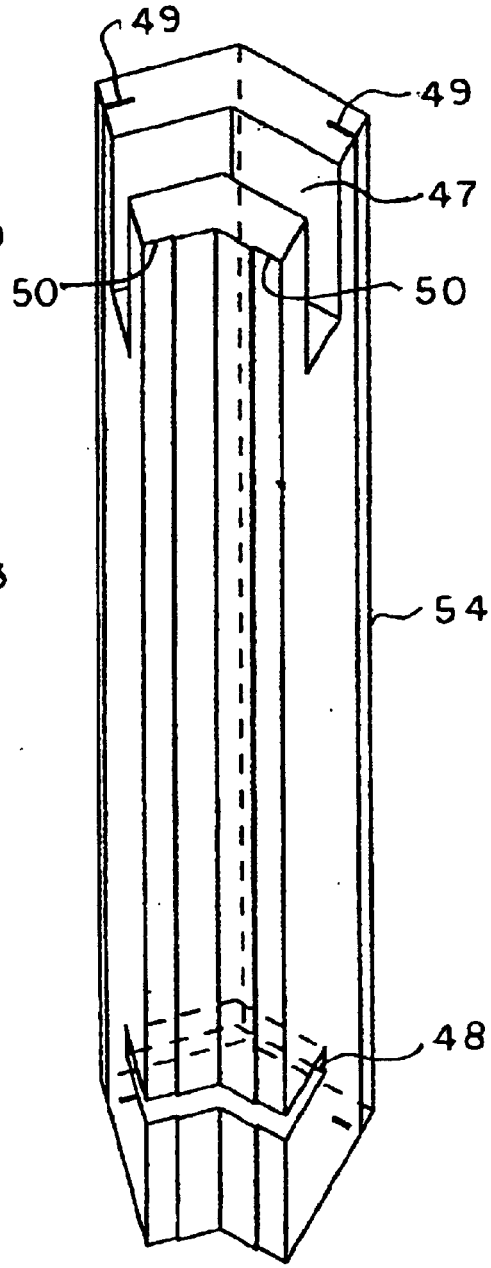
FIG. 14 Shows a perspective view of an outside 45 degree corner insulated panel.
Figure 15:
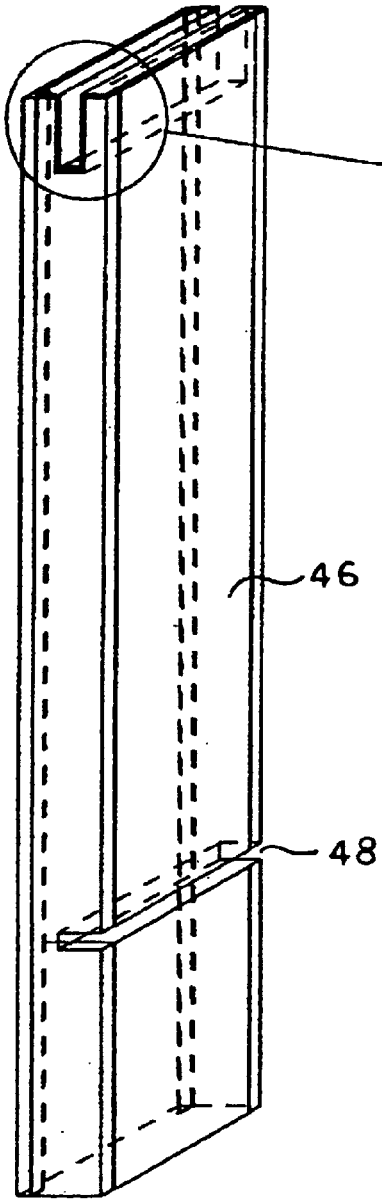
FIG. 15 Shows a perspective view of a straight insulated panel.
Figure 16:
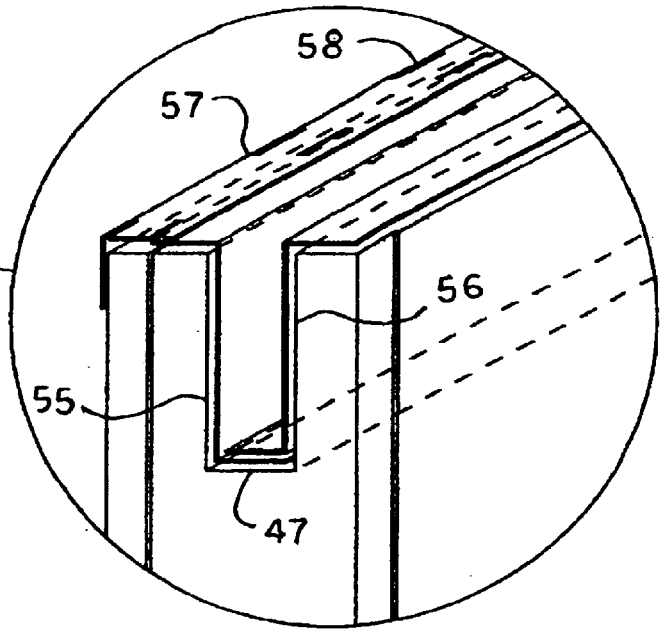
FIG. 16 Shows a perspective blow-up view top ⅃ and ⅂ shaped headers.
Figure 17:
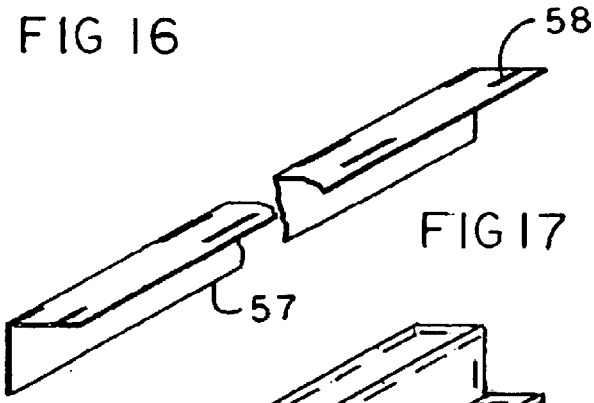
FIG. 17 Shows a perspective view of a slotted angle.
Figure 18:
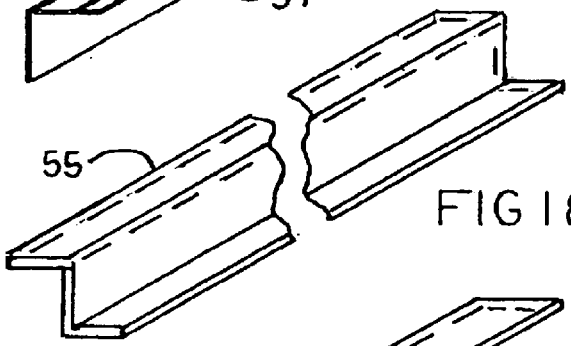
FIG. 18 Shows a perspective view of a ⅂ shaped header.
Figure 19:
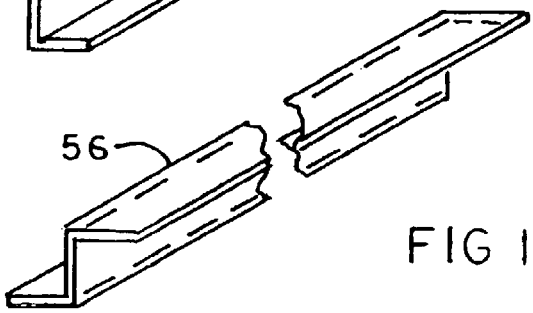
FIG. 19 Shows a perspective view of a ⅃ shaped header.
Figure 20:
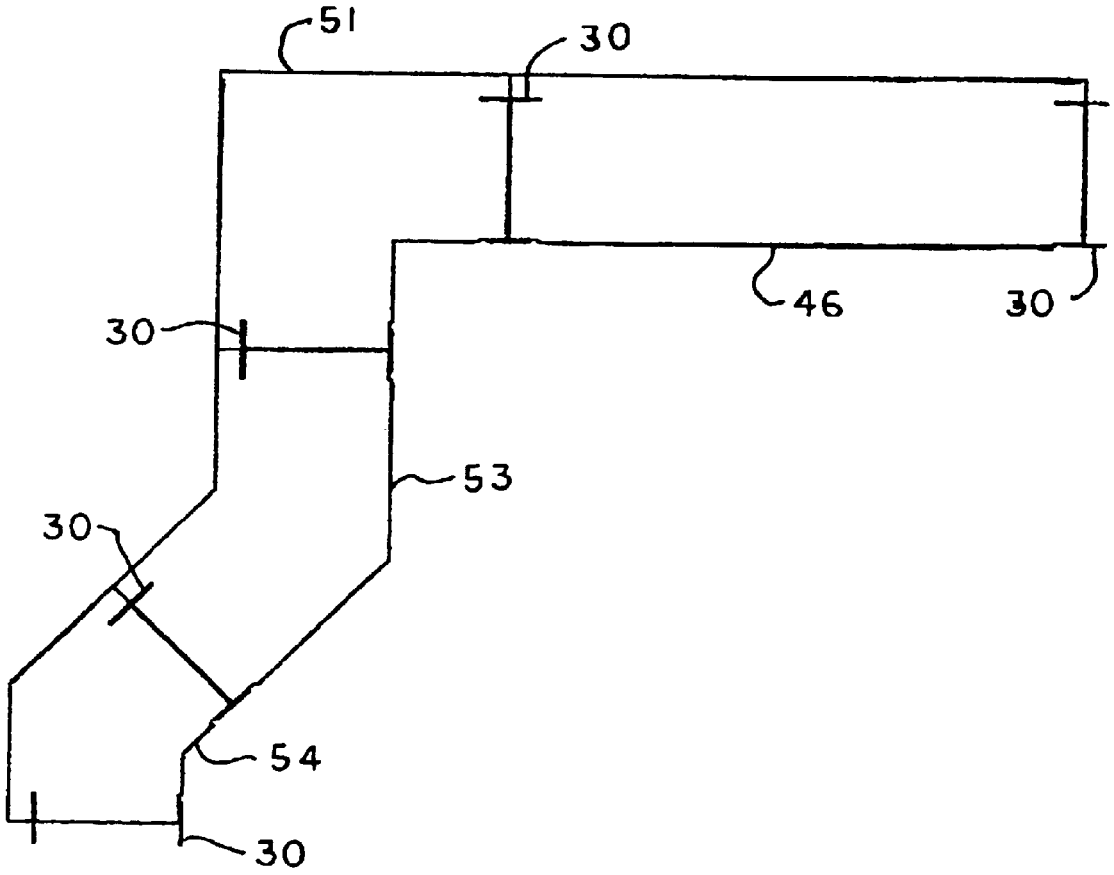
FIG. 20 Shows a top view of the thermal steel framing stud and insulated panel assembly.
Figure 21:
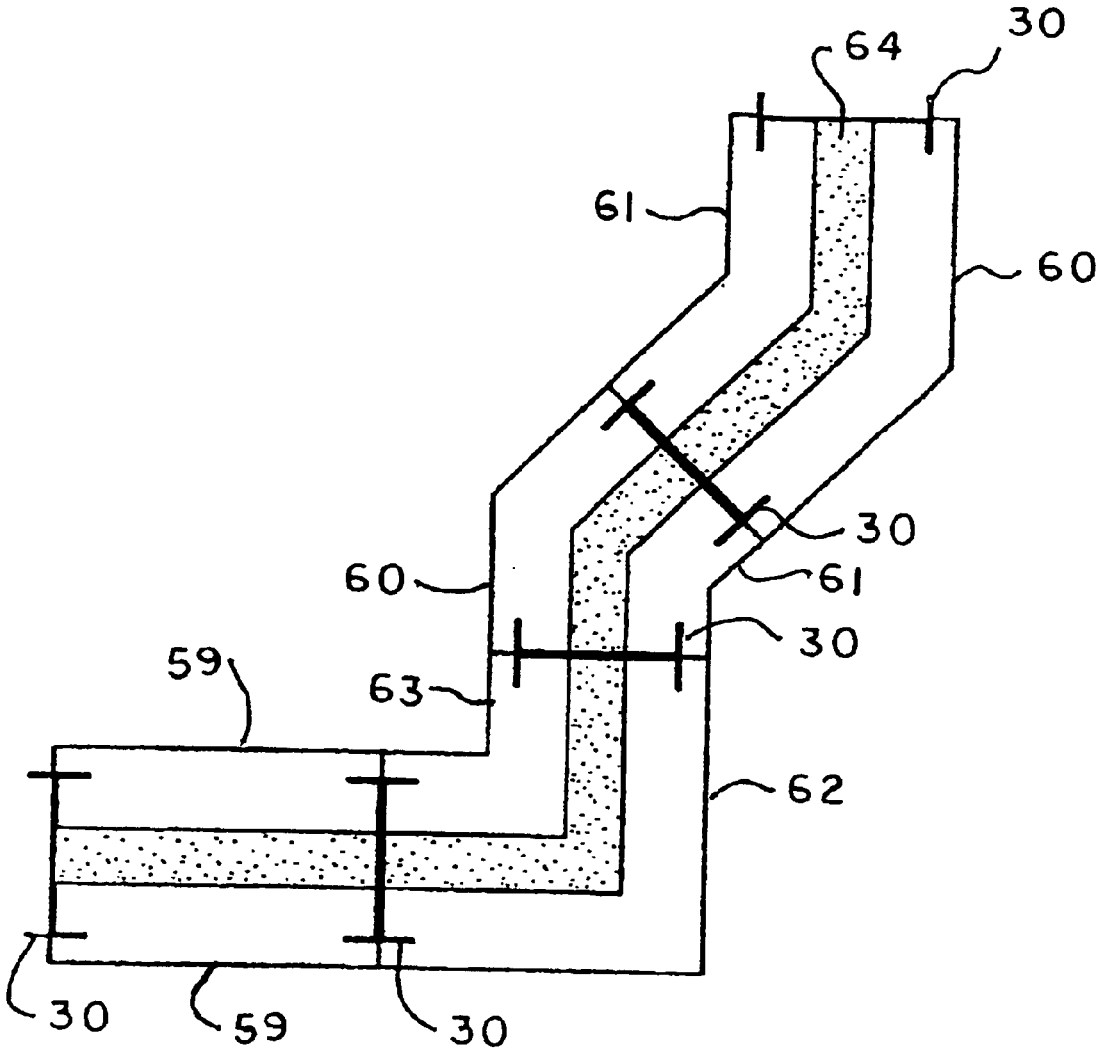
FIG. 21 Shows a top view of the steel framing stud and insulated concrete panel assembly.

The structural thermal framing and panel system for assembling finished or unfinished walls with multiple combination for pour and non poured wall 29, shown in FIGS. 1-27 comprises at least one framing stud assembly 30, FIG. 3 and FIG. 4, having one first end 31, which is more generally referred to as a stud element of the framing stud assemble. FIG. 3 and FIG. 4, having sufficient thickness, width and length, having one web 33, FIG. 3 and FIG. 4, having sufficient thickness, width and length, one flange 35, FIG. 4, having sufficient thickness, width and length, at least one interlock tab 38, FIG. 4, having sufficient thickness, width and length, one top tab 39, FIG. 3, having sufficient thickness, width and length, one bottom tab 41, FIG. 3, having sufficient thickness, width and length, at least one electric utility hole 44, FIG. 4, having sufficient area to accommodate electric conduit. One second end 32, which is more generally referred to as a stud element of the framing stud assembly, FIG. 3 and FIG. 4, having sufficient thickness, width and length, having one web 34, FIG. 3 and FIG. 4, having sufficient thickness, width and length, one flange 36, FIG. 4, having sufficient thickness, width and length, at least one slotted interlock receiver hole 37, FIG. 4, having sufficient area to accommodate interlock tab 38, FIG. 4, located on said first end 31, FIG. 3 and FIG. 4, one top tab 40, FIG. 3, having sufficient thickness, width and length, one bottom tab 42, FIG. 3, having sufficient thickness, width and length, at least one rebar holder 43, FIG. 4, having sufficient thickness, width and length and having sufficient area to accommodate required horizontal rebar, at least one electric utility hole 45, FIG. 4, having sufficient area to accommodate electric conduit, FIG. 1, shows a structural thermal framing and panel system with multiple panel combinations for nonpoured wall comprising of at least one said framing stud assembly 30, FIG. 3, at least one straight insulated panel 46, FIG. 5 and FIG. 6, having sufficient thickness, width and length, at least one outside 90 degree corner insulated panel 51, FIG. 7 and FIG. 8, having sufficient thickness, width and length and/or at least one inside 90 degree corner insulated panel 52, FIG. 9 and FIG. 10, having sufficient thickness, width and length and/or having at least one inside 45 degree corner insulated panel 53, FIG. 11 and FIG. 12, having sufficient thickness, width and length, and/or having at least one outside 45 degree corner insulated panel 54, FIG. 13 and FIG. 14, having sufficient thickness, width and length all said panels having one top groove 47, FIG. 5, FIG. 6, FIG. 7, FIG. 8, FIG. 9, FIG. 10, FIG. 11, FIG. 12, FIG. 13 and FIG. 14, having sufficient area to accommodate ⊤ shaped header 55, FIG. 18, having sufficient thickness, width and length and ⊥ shaped header 56, FIG. 19, having sufficient thickness, width and length, at least one ⊥ shaped slotted connector angle 57, FIG. 17, having sufficient thickness, width and length and having multiple slotted received hole 58, FIG. 17, to accommodate top tab 39, FIG. 3, and top tab 40, FIG. 3, said panels having groove 48 having sufficient area to accommodate electric utility conduit, having slot 49 having sufficient area to accommodate said framing stud flange, having two inset area 50 having sufficient area to accommodate same framing stud flange. Said groove 48, slot 49, inset 50 are shown in FIG. 5, FIG. 6, FIG. 7, FIG. 8, FIG. 9, FIG. 10, FIG. 11, FIG. 12, FIG. 13 and FIG. 14.

Figure 22:
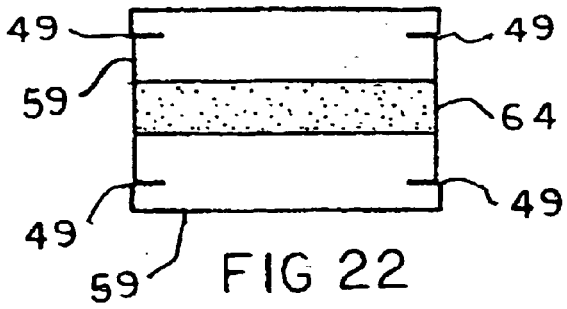
FIG. 22 Shows a top view of a straight insulated concrete panel.
Figure 23:
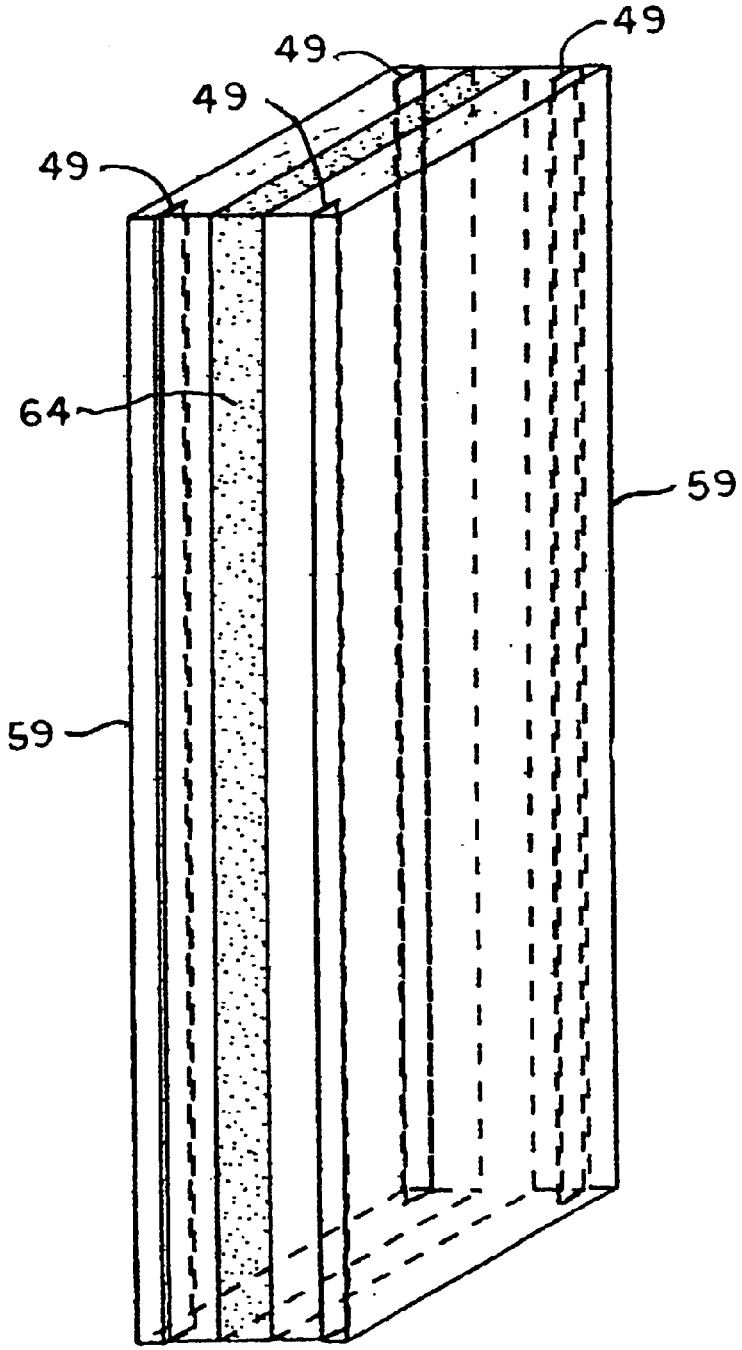
FIG. 23 Shows a perspective view of a straight insulated concrete panel.
Figure 24:
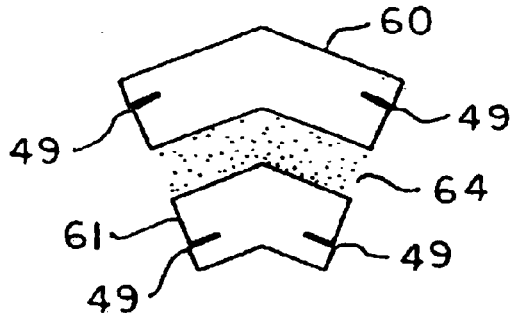
FIG. 24 Shows a top view of a 45 degree corner insulated concrete panel.
Figure 25:
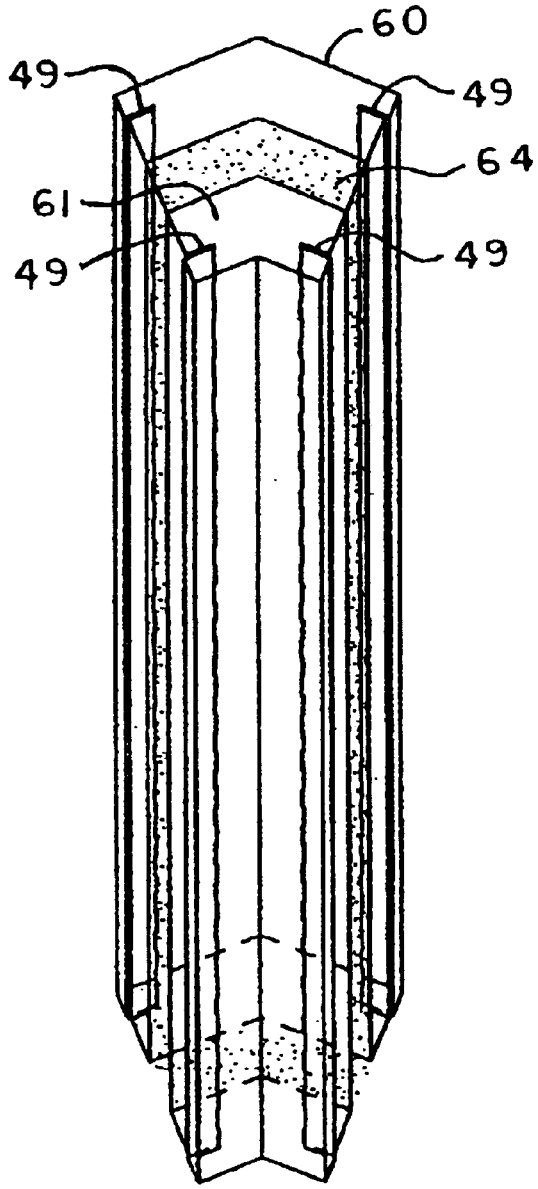
FIG. 25 Shows a perspective view of a 45 degree corner insulated concrete panel.
Figure 26:
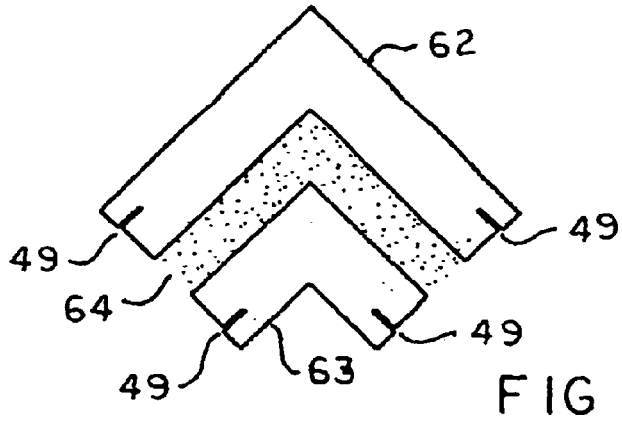
FIG. 26 Shows a top view of a 90 degree corner insulation concrete panel.
Figure 27:
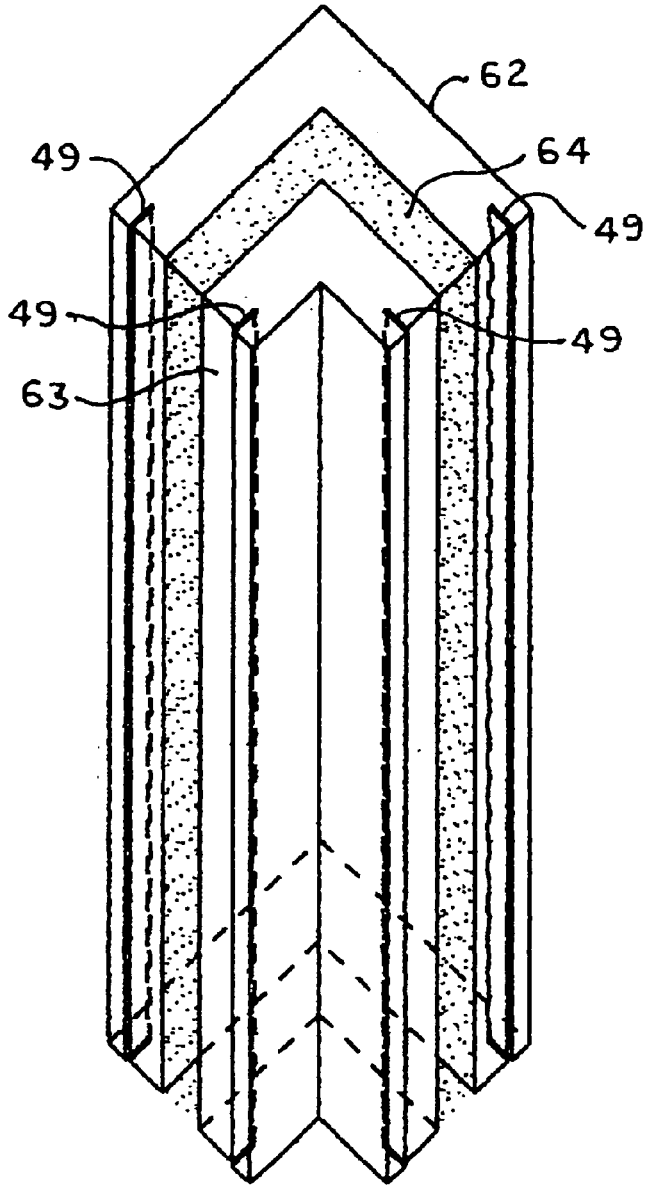
FIG. 27 Shows a perspective view of a 90 degree corner insulated concrete panel.

FIG. 2 shows a structural thermal framing and panel system with multiple panel combinations for poured wall comprising of at least one said framing stud assembly 30, FIG. 3, at least two straight thin insulated panel 59, FIG. 22 and FIG. 23, having sufficient thickness, width and length, at least one 45 degree long corner thin insulated panel 60, FIG. 24 and FIG. 25, having sufficient thickness, width and length and/or at least one 45 degree short corner thin insulated panel 61, FIG. 24 and FIG. 25, having sufficient thickness, width and length, and/or at least one 90 degree long corner thin insulated panel 62, FIG. 26 and FIG. 27, having sufficient thickness, width and length, and/or having at least one 90 degree short corner thin insulated panel 63, FIG. 26 and FIG. 27, having sufficient thickness, width and length. Said panels 59, 60, 61, 62, 63 having concrete filler 64, FIG. 22, FIG. 23, FIG. 24, FIG. 25, FIG. 26 and FIG. 27, having sufficient thickness, width and length between said panels. The structural thermal framing and panel system for assembling finished or unfinished walls with multiple panel combinations for poured and nonpoured walls 29 make up components may be made from concrete, stone, brick, foam, plastic, wood, iron, steel, aluminum or any other type metal, polyurethane type composite with fiber glass, high density expanded polystyrene, plastic or any combination of these materials.

A structural thermal framing and panel system 29 is provided for assembling finished or unfinished walls with multiple panel combinations for nonpoured walls. The structural thermal framing and panel system 29 includes at least one framing stud assembly 30 and at least one straight panel 46. The structural thermal framing and panel system 29 can also include at least one outside corner panel 62 and/or at least one inside corner panel 63. Each corner panel can be insulated and can have a bend of about 90 degrees or about 45 degrees. The structural thermal framing and panel system can also include at least one top header 55, 56, and at least one L shaped slotted connector angle 57 and at least one slotted received hole for the top tab 39/40. The top header can be Z shaped or reverse Z shaped.

The framing stud assembly 30 can include a first end 31 with a web 33, a flange 35, at least one interlock tab 38, a top tab 39, a bottom tab 41, and at least one electric utility hole 44 having sufficient area to accommodate electric wires. The framing stud assembly 30 can also include a second end 34 with a web 34, a flange 36, at least one slotted interlock receiver hole 37 having sufficient area to accommodate the interlock tab 38 located on the first end and allowing the interlock tab 38 to firmly hold the first end 31 to the second end 32, a bottom tab 42, at least one electric utility hole 45 having sufficient area to accommodate electric wires, and at least one rebar holder 43 for holding at least one horizontal rebar 65.

The straight panel 46 can include a top header 55/56, a top groove 47 having sufficient area to accommodate the top header 55/56, at least one L shaped slotted connector angle 57 having at least one slotted receiver hole 58 to accommodate the top tab 39/40 located on the framing stud top surface, and inset area locations having sufficient area to accommodate the flange located on the framing stud assembly. The inset area and the slot are used to locate the framing stud assembly 30 on the straight panel 46.

The corner panel can include a top header 55/56, a top groove 47 having sufficient area to accommodate the top header 55/56, at least one L shaped slotted connector angle 57 having at least one slotted receiver hole 58 to accommodate the top tab 39/40 located on the framing stud top surface, inset area locations having sufficient area to accommodate the flange located on the framing stud assembly, and slot locations for the flange on the framing stud assembly 30. The inset area and the slot are used to locate the framing stud assembly 30 on insulated panels 46.

The straight insulated panel 46 can also include at least one corner thin panel having a bend of about 90 degrees and configured in a long bend, short bend or a combination of both. The corner thin panel can also have a bend of about 45 degrees. Concrete filler can be placed between the panels.

The panels 46 can also include a slot 48 in locations for the flange on the framing stud assembly 30. The L shaped slotted connector angle 57 includes at least one slotted receiver hole 58 to accommodate the top tab located on the framing stud top surface. Inset area locations have sufficient area to accommodate the flange located on the framing stud assembly 30. Slot locations for the flange are provided on the framing stud assembly 30. The inset area and slot are used to locate the framing stud assembly 30 on the straight thin insulated panel 46 and the corner thin panel 62/63.

The top tab 39/40 may be bent at an angle of about 90 degrees after being received through the slotted received hole 58 in the L shaped slotted connector angle 57. Additionally, the bottom tab 66 may be bent at an angle of about 90 degrees to be used to attach the framing stud assembly 30 to the footing 68. The framing stud assembly 30 can also include at least one interlock tab 38 located on the first end 39 and at least one interlock receiver hole 37 located on the second end 32 allowing the framing stud assembly 30 to be adjusted to various wall widths.

In various embodiments of the present invention, interior forms, exterior forms or panel forms are supported by stud frames. The forms or panel forms can be arranged to defined a space for receiving filler materials. The filler material includes concrete, sand, gravel, portland cement, or any other wall building material known to those skilled in the art. Each stud frame can include an interior form holder and an exterior form holder. The holders can include an outside flange. If the form or forms need to be held in place until the filler is poured, adhesive or fasteners are used to secure the forms to the flange. In the embodiment shown, vertical support or stud frame extend from the top to the bottom of the wall. The two piece support of each stud frame may be tied together. To reconnect the stud frame, which is in two parts, rebar 65 extends through the interior of the wall and is supported by the bend out brackets of the web.

A side view of several stud frames and forms are shown standing on a footing. The stud frames are connected to the footing 68 by fastening tabs or L channels 66. One embodiment includes two lengths of angle sheet metal or iron which are secured to the footing 68 by concrete nails or bolts. The stud frames are then connected to the anchor by metal screws. In alternative embodiments, the stud frames are secured to the anchors by welding or any other means known to those skilled in the art. In a further embodiment, no anchors are necessary because the stud frames are fastened to the footing 68 with the fastening tabs on the stud frame or they can be set in the footing 68 while the concrete of the footing 68 is still wet.

In an example of an embodiment of the present invention, a standard eight foot wall comprises two three inch thick forms and a concrete core having one of a variety of thicknesses, such as about six inches for a total wall thickness of about twelve inches. Note that forms and stud frames come in various thicknesses, widths, and heights for various applications and may also be pre-assembled into bigger sections or as complete walls prior to delivery to the job site. The stud frames are vertically positioned approximately one to four feet apart, or other effective spacing. The stud halves of the stud frame are approximately two inches wide and the outside flanges are spaced about six to twenty about four inches apart. The connection points of the studs, for example, slotted interlock receiver hole 37 and interlock tab 38 are spaced about six to about twelve inches, one above the other. The connection points of the stud frames can be made from galvanized steel and connected by spot welding or other known methods of fastening. The stud frames can alternatively be connected by hook brackets that can hook to each other or to the rebar. The forms can be made of expanded polystyrene (EPS) having variable densities. The form types are cut, extruded, or molded from standard EPS or other types of expanded light weight materials which have preferably been treated with flame and smoke retardants and treated to resist insects. Specifically, sheets of expanded polystyrene can be obtained, for example, from AFM Corporation, P.O. Box 246, Excelsior, Minn. 55331, or one of its affiliates. Compared to a twelve inch thick solid concrete wall, which has an R rating between six and eight, the above-described wall's have an effective R rating of approximately twenty-five to fifty depending on panel type and configuration used.

In a further embodiment, the stud frame includes one piece of sheet metal that is cut, formed, and connected into a one piece structural element capable of supporting several thousand pounds. However, only a single connection is placed at the top of each stud frame to tie the stud halves together. Thus, in this embodiment, the supports are secured at the bottom by the anchors and at the top by a connection.

In a retaining wall application of the present invention, each stud frame comprises a single support. The stud half also includes one set of holders for holding a single set of forms. A trench is cut in the ground and the forms are assembled so the forms are opposite a wall of earth wherein the space for fillers is defined between. Struts extend from the stud half of each stud frame into the wall of earth to steady the studs.

In a process for assembling the wall forms, the footing of the foundation is first poured. Once the footing has solidified, anchors are secured to the footings 68. Next, a stud frame is placed upright on the footing 68 and secured to the anchors. In some panels an exterior form can then be connected to the first stud frame. Similarly, an interior form can also be connected to the first stud frame at a position opposite to the exterior form. A space for receiving filler is thereby defined between the forms. A second stud frame is then placed upright on the footing 68 and secured to the anchors. The second stud frame is then connected to both the interior and exterior forms. Additional stud frames and forms are then added until the entire wall forms are arranged in place. Other panels are connected in a similar fashion. The tops of the stud frames are then connected to each other to provide more stability. Finally, rebar 65 is inserted between the interior and exterior form and placed through the rebar positioners of the struts.

Once the forms are properly in place, the wall is formed by pouring filler into the forms. A process for this procedure is accomplished by pouring the filler into the bottom portion of the forms. The filler in the bottom portion of the forms is allowed to partially set. Once the filler has begun to harden, additional filler is poured on top of bottom portion of filler. This additional layer of filler is also allowed to partially set. The pouring and setting is continued until the desired wall height is achieved. In some panel type configurations, where additional exterior panel support is added, filler may be poured in continuous lifts.

In another embodiment of the invention, a window is cut in the forms. In this embodiment, a hole is cut in the interior forms and form holders which pass through the window area. Similarly, a hole is cut in the exterior forms and form holders of the braces which pass through the window area.

The stud halves and connections are also removed from the window area. In order to prevent filler from flowing out of the holes, a tube is placed in the window to form the circumference of the space. The window, of course, may be practically any shape desired. In one embodiment, the tube includes sheet metal and has flanges which extend beyond and wrap around the outside of both the interior and exterior forms. In another embodiment, window and door areas are closed off by sliding in filler pieces around the areas that will not be filled. These pieces slide in-between each panel and lock in place due to a keyed grooving process incorporated in the panel form. This allows the user to have the ability to close off various areas of the panel simply by sliding in the filler pieces. Also, this allows one type of panel to be poured to various wall thicknesses. Post and beam combinations or solid unfilled walls can be used with wood or steel type header elements instead of concrete.

In another embodiment of the invention, the filler is poured into the defined spaces in the forms to create the wall. Once the filler has been poured and set, the forms are not removed. Rather, the forms remain a permanent part of the wall to improve the thermal characteristics and structural integrity of the wall.

In further embodiments, channels are cut into either the interior or exterior of the form for installing electrical or plumbing conduits. A channel is cut into a number of exterior forms and spans across several stud frames. Any means may be used to cut the channel into the forms.

In another embodiment of the invention, a wallboard is attached to the interior or exterior of the formed wall. In this embodiment, the braces comprise wallboard hangers which extend between two adjacent forms. The wallboard hanger includes any suitable material known to those skilled in the art, such as metal, plastic, wood, etc. Further in alternative embodiments, the wallboard hanger does not include a single strip that runs the length of the brace, rather it includes several smaller hangers such that each hanger extends only over a portion of the brace. These smaller hangers are arranged at various locations along the brace between two adjacent forms. In other embodiments, the hangers are embedded in the forms or protruded through holes in the forms. A wallboard can be positioned against the wallboard hangers. Fasteners secure the wallboard to the wallboard hangers. Fasteners include screws, nails, spot welds, rivets, glue, etc. Any type of wallboard may be secured to the wallboard hangers such as sheet rock, wood panels, vinyl siding, metal siding, brick or stone facades, etc. Alternatively, a support mesh is attached to the forms to serve as a support for a stucco surface. In particular, Elastomeric Synthetic Plaster (Stucco) "Perma-Flex" is applied directly to the wall as recommended by El Rey Stucco Company of 4100 Broadway SE, Albuquerque, N. Mex., 87105.

In one embodiment, the member, which serves as the wallboard hanger, serves a dual function: (I) it is a hanger to which fasteners are attached to secure wallboard to the wall; and (2) it is the outer flange which holds the forms.

The width of the supports depends on the weight of the wallboard and the size of the conduits required for the particular application. In embodiments where no conduits are to be embedded in channels of the forms, the supports may be thicker than the forms so they project into the space for the filler. Also, in embodiments requiring heavy wallboard, the supports should be thicker or made of a material having sufficient strength to sustain the wallboard.

Another embodiment of the invention provides forms that are a pre-finished substrate. A desired substrate suitable for the climate where as any or all substrates in use may be applied to forms before delivery. Specifically, a fiber reinforced acrylic modified cement type product can be used on the panels or forms.

CONCLUSION AND SCOPE OF INVENTION

Accordingly, the reader will see that the structural thermal framing and panel system for assembling finished or unfinished walls with multiple panel combinations for poured and nonpoured walls of this invention has the ability to be installed in a fraction of the time compared to masonry or solid concrete walls with about the same or less in total material costs. Furthermore, the structural thermal framing and panel system has the additional advantages in that:

- it provides an improved thermal-efficient, cost effective permanent wall framing and wall forming system which holds the building panels in a desired position so the resultant wall in straight.
- it provides a finished wall which has much greater structural integrity than previous wall forming systems.
- it provides for a permanent stud frame with a plurality of forms or building panels with a defined space for receiving filler, and wherein the framing stud substantially conforms to a portion of the forms or building panels and resists bending in the wall.
- it allows the framing stud web to become part of a rigid inner and outer cord or flange that is offset from the outer edge of the concrete, thus moving the compression and tension zone out from the center axis point.
- it provides comparable in overall strength to a much thicker concrete wall and also has better seismic properties.
- it allows all panels or panel forms in this system to be prefinished on the exterior facings prior to delivery.
- it allows the framing stud assembly to adjust to different wall thickness, so that the same framing stud assembly has multiple use.
- it provides a wall forming system to utilize the structural strength of the framing stud assembly in reducing the amount of concrete and rebar needed to form a structurally sound wall.
- it allows a plurality of permanent panel forms in combinations with or without concrete.
- it provides bottom bend out tabs for holding the framing stud assembly to the footing or floor.
- it provides top bend out tabs for holding the framing stud assembly to the adjoining form panels.
- it allows panels to be precoated with cementitious fiber or wire type reinforced hard coat finish for exterior facing of the forms that can be taped or meshed at the seams and a finished coat.
- it allows the ability to fasten the framing stud assembly to footings or other substrates without the use of "L", "C", or "U" channel usually required by prior art.

Although the description above contains many specifications, these should not be construed as limiting the scope of the invention but merely of some of the presently preferred embodiments of of the invention should be determined by the their legal equivalents, rather than by the examples

I claim as my invention:

1. A method for assembling a wall, comprising the steps of:

attaching a first slotted connector angle to a floor at a location where a wall is desired to be built, said slotted connector angle having slots spaced at a distance from one another corresponding to a desired spacing of studs;

providing a stud element, said stud element comprising: first and second flange elements; and bottom and upper tab elements at the respective bottom and upper ends of said stud element, each tab element being adapted for connection to a slot of the first slotted connector angle;

attaching a wall panel to the first flange element of said stud element;

inserting the bottom tab element of said stud element into a corresponding slot of the first connector angle;

repeating said steps of attaching of a wall panel to additional first flange elements of additional stud elements, inserting of the bottom tab element of such additional stud elements into adjacent slots of the first slotted connector angle, and the further step of attaching the second flange element of each additional stud element to the previous wall panel, until a portion of a wall is formed of a first line of stud elements and associated wall panels; and attaching a second slotted connector element to the top tab elements of each of the stud elements in order to provide additional support to the portion of the wall formed in the preceding steps.

2. A method for assembling a wall according to claim 1, further comprising the steps of:

providing a stud element, said stud element comprising: first and second flange elements; and upper tab elements at the upper end of said stud element, said upper tab element being adapted for connection to a slot of a slotted connector angle;

attaching a wall panel to the first flange element of the stud element;

connecting said stud element to the opposing stud element of the first line of stud elements inserted into the first slotted connector angle;

repeating said steps of attaching of a wall panel to additional first flange elements of additional stud elements, connecting each additional stud element to opposing stud elements, and the further step of attaching each additional stud element to the previous wall panel, until the wall is formed of a second line of stud elements and associated wall panels; and attaching a third slotted connector to the upper tab elements of each of the stud elements in said second line of stud elements in order to provide additional support to the portion of the wall formed by said second line of stud elements and associated wall panels.

3. A method for assembling a wall according to claim 2, wherein:

providing a support element on at least some of said stud elements that are adapted to support horizontal steel reinforcement rods in a location between the lines of wall panels attached to the first and second lines of stud elements; and placing horizontal reinforcement rods onto said support elements.

4. A method for assembling a wall according to claim 3, wherein there is a space between the wall panels attached to the first line of stud elements and the wall panels attached to the second line of stud elements, and further comprising the step of pouring cement into said space.

5. A method for assembling a wall according to claim 2, wherein there is a space between the wall panels attached to the first line of stud elements and the wall panels attached to the second line of stud elements, and further comprising the step of pouring cement into said space.

6. A method for assembling a wall according to claim 1, wherein the slotted connector angle is attached to the floor at a location on the inside margin of the wall.

7. A method for assembling a wall according to claim 1, wherein the slotted connector angle is attached to the floor at a location on the outside margin of the wall.

8. A method for assembling a wall according to claim 1, wherein the first slotted connector angle is L-shaped.

* * * * *